United States Patent [19]

Frick et al.

[11] 4,281,619

[45] Aug. 4, 1981

[54] METHOD FOR APPLYING VISCOUS FLUID TO STOCK AND ROTARY VALVE FOR USE IN SAME

[75] Inventors: Richard H. Frick; Kenneth M. Enloe, both of Neenah, Wis.

[73] Assignee: Kimberly-Clark Corporation, Neenah, Wis.

[21] Appl. No.: 128,483

[22] Filed: Mar. 10, 1980

[51] Int. Cl.[3] ..... B05C 1/04; B05B 1/16

[52] U.S. Cl. ..... 118/325; 118/410; 427/284; 427/285; 427/286; 137/625.47

[58] Field of Search ..... 118/410, 411, 25; 427/284, 285, 286; 137/625.47; 118/325

[56] References Cited

U.S. PATENT DOCUMENTS

| | | | |
|---|---|---|---|
| 961,621 | 6/1910 | Leuckert | 137/625.47 X |
| 1,291,566 | 1/1919 | Lewis | 137/625.47 X |
| 1,499,149 | 6/1924 | Buhse et al. | 118/25 |
| 2,621,886 | 12/1952 | Mueller | 137/625.47 |
| 2,854,027 | 9/1958 | Kaiser et al. | 137/625.47 |
| 3,052,565 | 9/1962 | Chinn et al. | 118/411 X |
| 3,165,122 | 1/1965 | Sachnik | 137/625.47 |
| 3,233,865 | 2/1966 | Panzica et al. | 137/625.47 X |
| 3,277,868 | 10/1966 | Lockwood et al. | 118/410 |
| 3,476,631 | 11/1969 | Hoffman | 118/411 X |
| 3,542,072 | 11/1970 | Harris et al. | 137/625.47 |

*Primary Examiner*—Shrive P. Beck

*Attorney, Agent, or Firm*—Howard Olevsky; William D. Herrick

[57] ABSTRACT

A method for applying measured amounts of viscous material in a predetermined pattern in registry to a continuously moving sheet is provided which includes the steps of introducing the viscous material into a rotary valve having a bore in the valve rotor operatively communicative with the fluid inlet, and a passage radially communicating between the axial bore and an opening in the valve seat through which the material is dispensed onto the sheet stock. The length of the material dispensed to the sheet stock is determined by a slot formed on the surface of the valve rotor which surrounds the opening for the radial passage. Registry of the pattern is accomplished by correlation of the rotation of the valve with the rate by which the sheet material passes underneath the valve orifice. The valve containing the slot and related apparatus is also part of the invention.

9 Claims, 7 Drawing Figures

METHOD FOR APPLYING VISCOUS FLUID TO STOCK AND ROTARY VALVE FOR USE IN SAME

FIELD OF THE INVENTION

This invention relates to a method for applying a viscous fluid in a reproducible linear pattern in registry on sheet goods and a rotary valve adapted for carrying out the method.

BACKGROUND OF THE INVENTION

One of the requirements in the manufacture of certain products at high speed commercial levels is the capacity to place in registry upon those products certain viscous fluid materials which can readily be converted to a solid state. Producing measured amounts of material in registry can be accomplished by a variety of means. These means, e.g. solenoids, rotary valves, computer controlled nozzles, etc. are mechanically coupled to a continuously moving belt of sheet stock so that application of measured amounts of fluid can be applied at specifically spaced intervals.

Difficulties are encountered, however, when it is desired to apply a pattern or line extending longitudinally along the length of travel of the sheet stock. These problems are particularly acute when the sheet stock is advanced at varying speeds and/or the pattern is applied in short cycles. Complicated pressure equalizing spray nozzles of complex configurations coupled with computer triggered feedback circuitry have been used in an attempt to provide precise longitudinal configurations. Because of the nature of the equipment and its sensitivity, many difficulties are encountered in high speed commercial operations. The process and apparatus of this invention provide a simple mechanical means for the application of viscous fluid to sheet stock in registry in precisely defined longitudinal patterns. A simple mechanical valve is utilized to perform this function and all of the advantages inherent in replacing complex circuitry with simple accurate mechanical apparatus are obtained.

SUMMARY OF THE INVENTION

The method of this invention involves the utilization of a rotary valve as a means for both applying a predetermined amount of the viscous fluid in registry along a continuously moving stock of sheet material and also applying this material in precise longitudinal configuration. The viscous fluid is introduced into a bore located along the longitudinal axis of the rotary valve rotor. The valve rotor has an axial passage radially communicating with the bore and the surface of the valve seat forming a discharge orifice. Adhesive flows through the discharge orifice which may be in the form of a nozzle and onto the sheet material passing continuously below it. Registry is accomplished because the rotor rotates so that the radial passage is either in alignment with the outlet on the valve seat providing fluid communication and discharge to the surface of the sheet stock or, the communication is disrupted. The longitudinal pattern is determined by the existence of a slot on the surface of the valve rotor which surrounds the outlet from the a radial passage. As a result of positive feeding pressure, the bore and the a radial passage are full and the adhesive or other viscous fluid also fills the slot. While the quantity of the material is determined by such factors as the pressure in the system and the correlation between the speed of rotation and the volume of the a radial passage, the longitudinal pattern is determined by the angle of the slot as it extends circumferentially around the surface of the valve. During rotation of the valve, the slot and the a radial passage are full of fluid and discharge of fluid will be obtained when either the slot portion or the a radial passage is aligned with the orifice on the valve seat. Discharge will continue until both the a radial passage and the slot are no longer in fluid communication with the orifice. By coupling the speed of the sheet material passing underneath the orifice with the speed of rotation of the valve as well as the arcuate configuration of the slots, precise longitudinal lines can be laid down on the sheet stock in registry.

DETAILED DESCRIPTION OF THE INVENTION

The invention may more readily be understood by reference to the drawings in which FIG. 1 is a longitudinal cross section of a particular embodiment of this invention.

Figure 1:
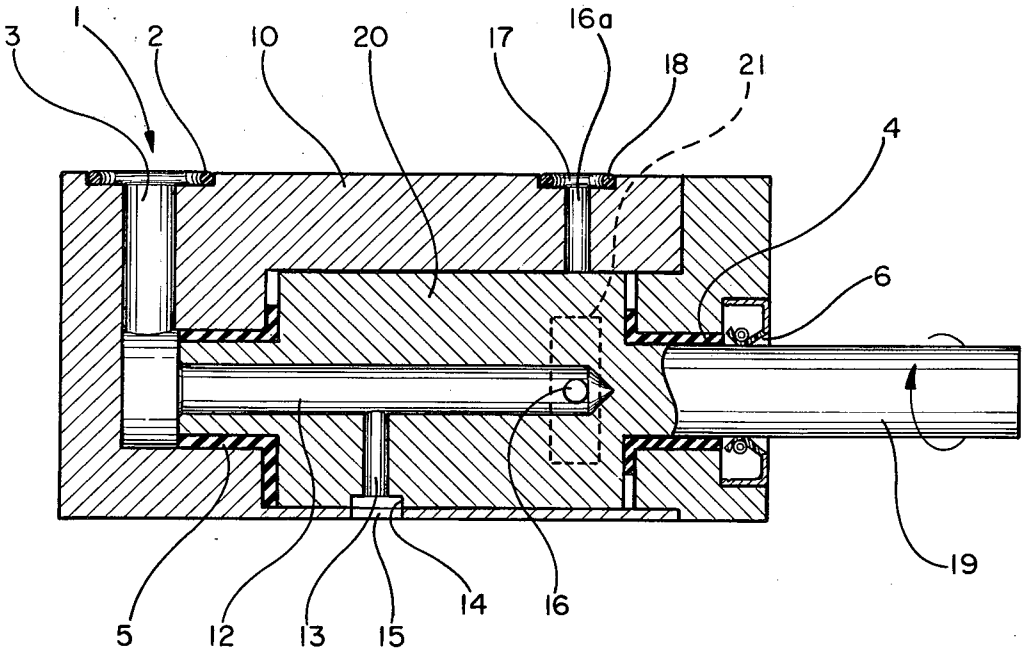
Figure 5:
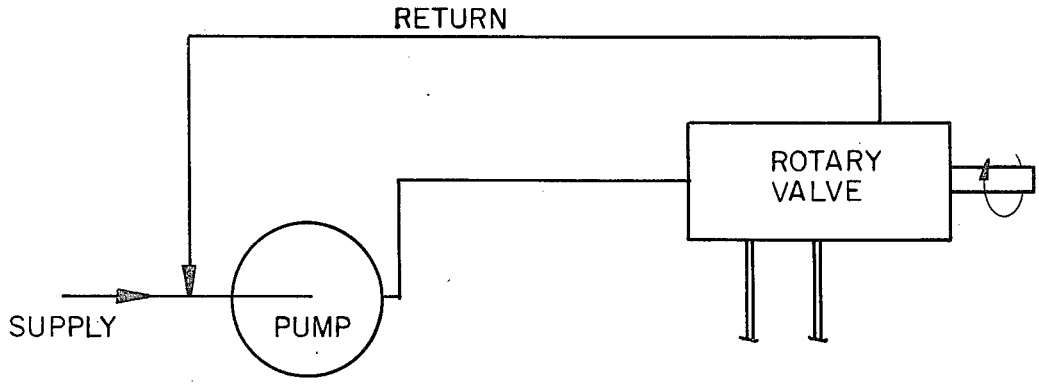
FIG. 5 is a diagrammmatic representation of the fluid flow of the viscous fluid through the application and return cycle and FIG. 6 is a diagrammatic representation of the valve in operation correlated with the sheet material flow.
Figure 6:
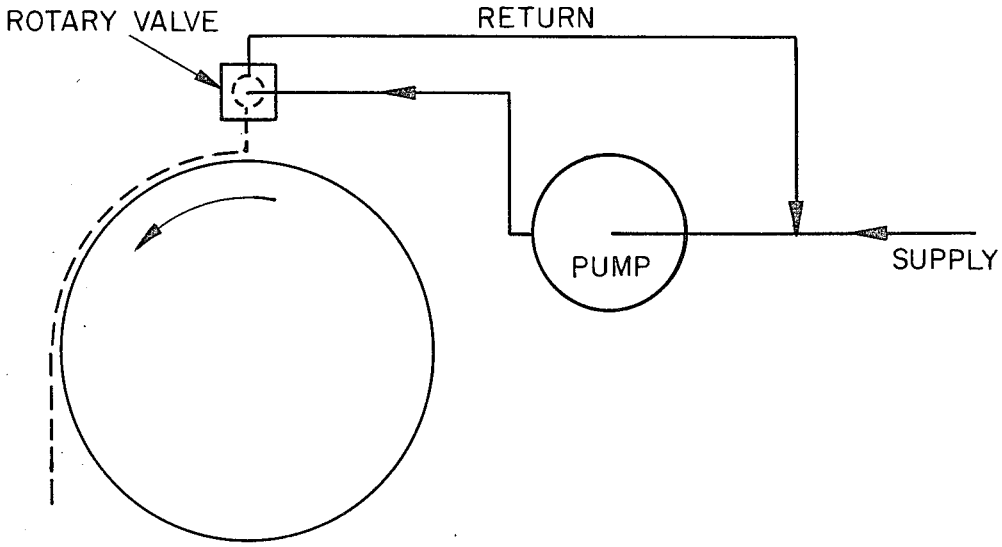

As can be seen by FIG. 1, the viscous fluid enters the valve through inlet 1 past housing orifice 17 through inlet channel 3. Sealed between the incoming conduit not shown and the housing is obtained by O-ring 2. The fluid passes through the inlet into the axial bore 12 of the rotary valve stem 20 and exits through a radial discharge passage 13 and out the housing orifice 15. The fluid also occupies the space defined by circumferential discharge rotor slot 14. (It should be noted that this slot can be on the housing.) As can be seen by reference to FIG. 5, the sheet stock is advanced directly in front of the orifice on the rotary valve and is continually moving while the fluid is being discharged through the orifice 15. As the rotor 20 continues its rotational movement, the discharge passage 13 will no longer be in communication with the orifice. At that point the supply of fluid to the orifice 15 has terminated but the fluid remaining in the radial discharge rotor slot portion 14 is still available for discharge purposes and is forced out as a result of the rotation of the rotor 20 thus producing a defined longitudinal segment in the machine direction of the sheet stock passing beneath the orifice. According to this invention, while the quantity of the material discharge is determined by conventional factors, the length of the longitudinal segment deposited is determined by the slot length and the rotational speed of the valve stem in correlation with the speed by which the material stock is advanced underneath the orifice.

Figure 2B:
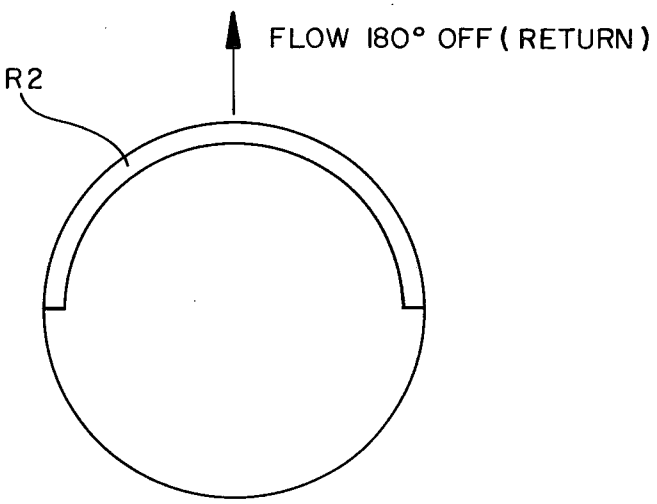
FIGS. 2A and 2B show slots on the rotary valve stem which correlate to the on position for material discharge and for a recycle respectively.
Figure 2A:
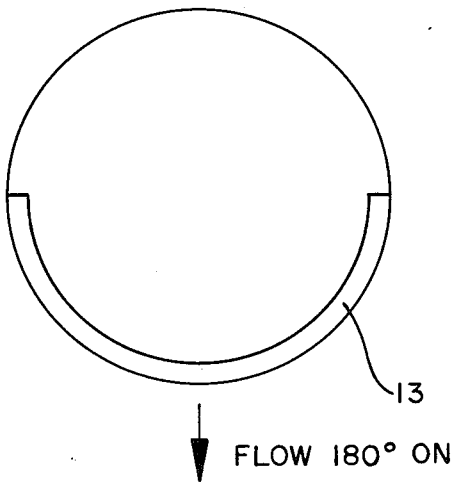
Figure 4:
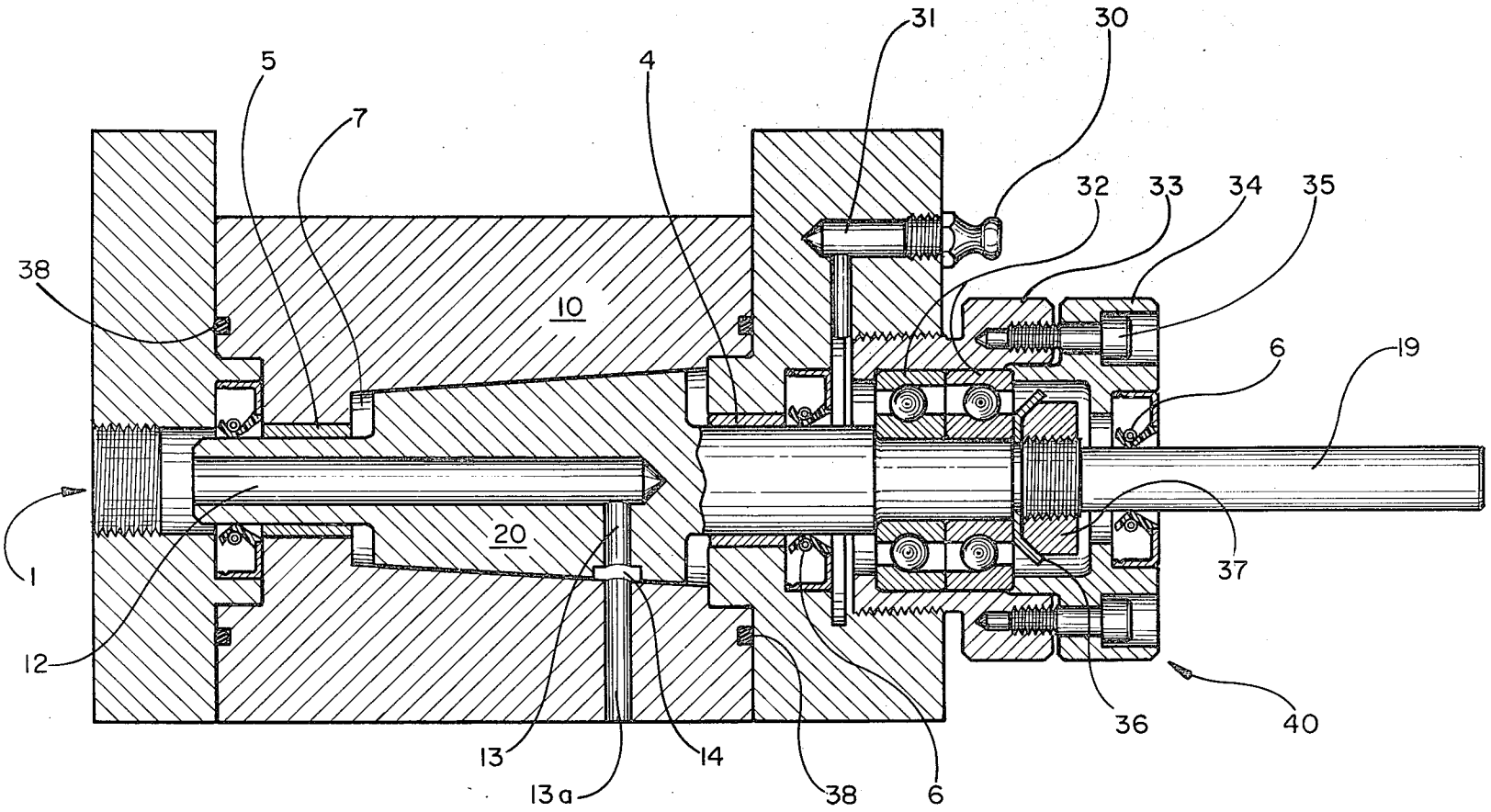

As can be seen in FIG. 1, an exit passage **16*a* in the housing is provided for fluid return. When the valve rotor 20 rotates so that fluid is no longer flowing through discharge passage 13, i.e. when rotation exceeds 180° (see FIG. 2A), communication with return passage 16*a* is provided by the next 180° rotation which aligns a radial return passage 16 in the rotor with return passage 16*a* in the housing and return orifice 17. The slot 13 can be any circumferential length greater than the orifice. In fact, if constant pressure feeding is used rather than constant displacement, the return system is not necessary as can be seen in FIG. 4. As is the case with the intake passage, this return passage is sealed with O-rings 18 to a conduit not shown. The fluid flow system is represented diagrammatically at FIG. 5. As can be seen by reference to FIGS. 1, 2A, 2B and 5, fluid constantly under pressure is either introduced into the discharge passage 13 or the radial return system 21 and is either discharged through orifice 15 or recycled through return passages 16 and 16***a*, depending upon which portion of the valve stem is in communication with the respective ports due to the rotation of the stem.

Figure 3:
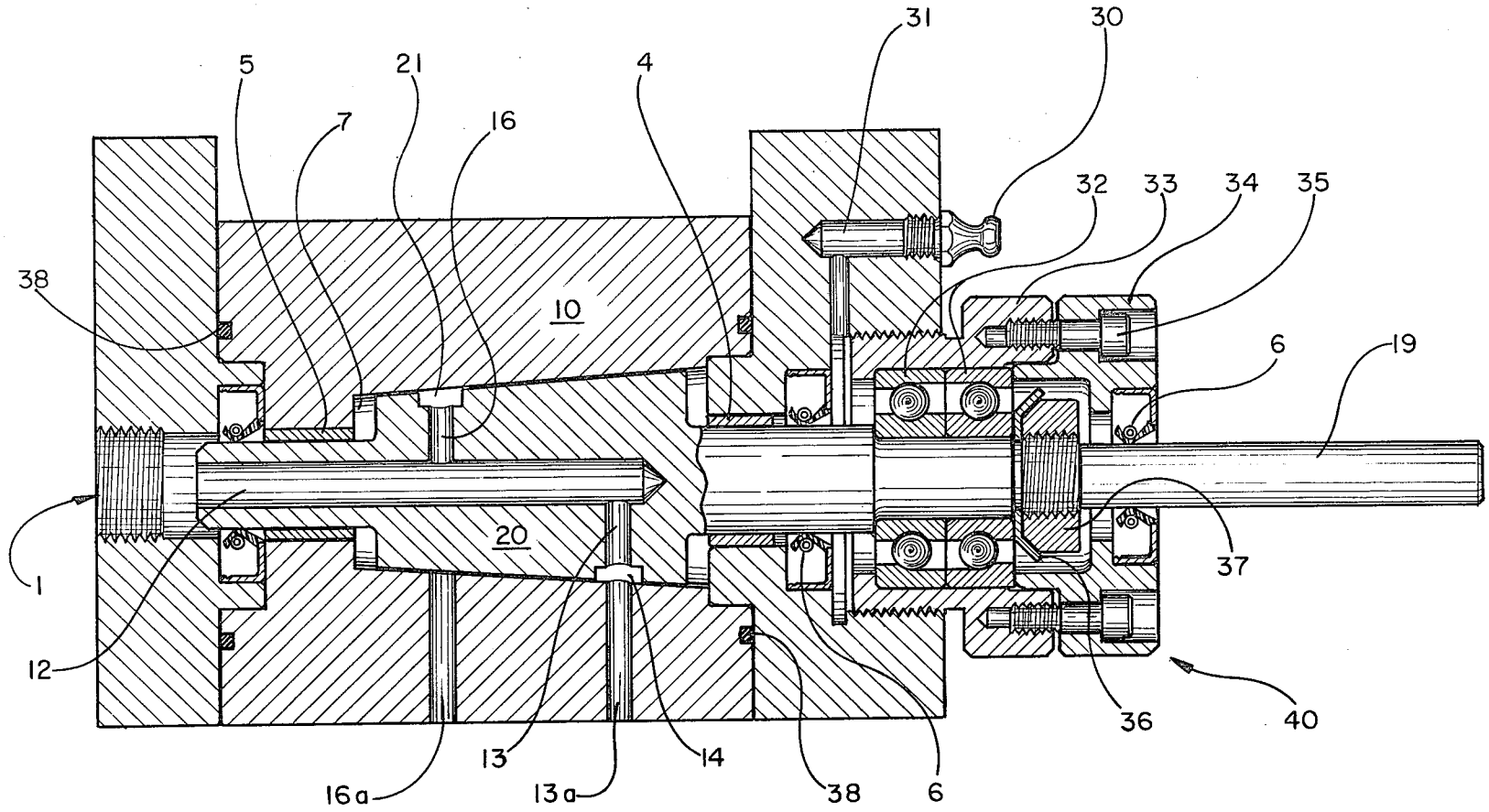
FIGS. 3 and 4 are longitudinal cross sections of alternative embodiments of the valve of this invention.

FIG. 3 shows an alternative embodiment to the valve depicted in FIG. 1. Like parts are labeled in like manner. The major difference between these embodiments is that the valve shown in FIG. 3 has a conical valve rotor seated in an appropriate cavity in the valve housing. An advantage of this particular configuration is that by the utilization of pressure on the valve stem directed from shaft 19, wear of the valve can be compensated for by sliding the valve stem towards the fluid intake direction. This allows for extended life of the valve before replacement and may be significant in certain commercial applications. As in the embodiment shown in FIG. 1, fluid enters under pressure through inlet 1 past inlet channel 3 and into axial bore 12 of the rotor 20. The fluid is then forced out through discharge passage 13 in the rotor while filling discharge rotor slot 14 while the rotor is rotated. After radial discharge passage 13 is no longer aligned with the corresponding discharge passage 13*a*, fluid continues to exit due to fluid retention in rotor slot 14. Discharge is provided as in FIG. 1 through rotor return passage 16, and housing return passage 16*a*. Valve housing seals 38 are added to provide fluid tight junctions between the individual housing components.

The clearance adjustment system 40 includes threaded bearing housing 33 for adjustment of the driving spindle 19. The housing rests on bearings 32 for ease in lateral shifting of the system 40. The shaft 19 is attached to the rotor 20 by locknut 37. Locking screws 35 mount the shaft subassembly including the shaft 19, locknut 37 and bearing cap 34 on the bearing housing 37. A rotor lubrication channel 31 sealed by fitting 30 is located on housing 10 to provide for rotor lubrication.

When the valve is assembled the adjustment system 40 is positioned so that passages 13 and 13*a* and 16 and 16*a* are in alignment as shown in FIG. 3. Also, as can be seen in FIG. 3, space 7 exists in the housing after alignment. As the rotor 20 wears during use the assembly 40 is shifted toward the intake direction and the rotor slides to the left diminishing the size of the space 7 and shifting the alignment of the passages slightly. In this way, the usable life of the valve can be substantially extended.

FIG. 4 is another embodiment of this invention and is identical to FIG. 3 except that return system 21 is lacking. Such a valve can be used when the feed means is not one employing constant pressure.

In order to carry out the teachings of this invention most advantageously, of course, the rotational movement of the valve, as mentioned before, is coupled to the lineal advancement of the sheet stock passing underneath the valve. Coupling of this type is well known in the art and the actual means of coupling does not provide part of this invention but the concept of utilizing such coupling along with the particular discharge feature of this valve provides an important feature of the inventive concept disclosed herein. Of course, the valve may contain more than one discharge orifice and if this is the case, then lineal patterns equal to the number of discharge orifices can be laid down on the sheet stock.

While the disclosure of this invention relates to the deposit of viscous materials the applicability extends beyond this feature. The broad concept of the invention, in essence, relates to the deposit of materials which will not substantially horizontally migrate along the surface of the material stock upon which is is deposited. If there is substantial migration, of course, the effects of the invention are minimized. Viscous materials such as quick setting adhesives are examples of materials which can be applied particularly beneficially. In addition, the application of thermoplastic elastic material which is fluid during application but can be fused and/or rendered solid in a particular discrete segment upon contact with sheet material is a highly beneficial use for the teachings of this invention and, the concept of rapidly applying a series of discrete thermoplastic strips in a premeasured configuration in registry is part of the inventive concept set forth herein. Such application has particular utility as a means for rapidly adhering discrete segments of elastic material to diapers.

One of the possible uses of this invention is the adhering of discrete elastic segments only in the portions which become the leg openings of diapers. Utilization of the precise method of application and registry for this purpose allows precise control of the placement of elastic, substantial savings in the amount of elastic utilized, and rapid production techniques.

When the utilization of elastic segments is desired, pressure in the system must be substantially increased and it is preferred that an extruder nozzle be used at the discharge orifice to provide precise control. The pressure and, perhaps, the addition of heat is necessary to maintain substantially fluid flow of this otherwise extremely viscous material. In addition, especially if it is necessary to apply heat to the thermal plastic, the sheet material may be conducted over a "chill roll". A chill roll by means of collants applied internally to the surface of the roll is designed to cool material passed over it.

What is claimed is:

1. An apparatus for applying measured amounts of fluid in registry, in a predetermined configuration to a continuously moving material sheet comprising:

I. a rotary valve having in combination:

(a) a rotor having;

(1) first and second circular faces, said first face having a port substantially centrally located therein;

(2) a longitudinal surface extending between said faces;

(3) an intake bore extending from said first circular face inwardly longitudinally toward said second face but terminating prior thereto;

(4) a first passage fluidly communicating and radially extending from said bore to said longitudinal surface;

(5) a slot portion in fluid communication with said passage at the longitudinal surface, and circumferentially extending around said longitudinal surface in an arc greater than that defined by said passage;

(b) a valve seat for rotatably mounting said rotor; said valve seat having:

(1) a fluid inlet fluidly communicating with said bore;

(2) a discharge orifice corresponding to said slot on said valve rotor and in fluid communication therewith when said slot and orifice are aligned as a result of rotation of the valve rotor; and II. a device for continuously advancing said sheet; and III. a means for mechanically coupling the advancing of said sheet with the rotation of the valve.

2. The valve according to claim 1 in which the rotor is cylindrical.

3. The valve according to claim 1 in which the rotor is in the shape of a truncated cone.

4. The valve according to claim 1 in which the rotor and casing are separated by a fluid tight gasket between a portion of said second face and the inner surface of said seat adjoining said face.

5. The valve according to claim 1 in which a drive shaft extends from said second face through an opening in said seat, said shaft substantially coaxial to said intake bore.

6. The valve according to claim 5 in which an O-ring is disposed about said shaft and at said opening in said seat.

7. The valve according to claim 1 in which the slot includes a nozzle.

8. The valve according to claim 1 in which a second passage in said valve rotor axially spaced from said first passage and fluidly communicating with said bore and another opening in said valve seat.

9. The valve according to claims 1, 3, 4, 5, 6, 7 or 8 wherein pressure means for shifting the valve in the direction of the shaft in response to wear are provided.

* * * * *